US007631774B2

(12) United States Patent
Foxx et al.

(10) Patent No.: US 7,631,774 B2
(45) Date of Patent: Dec. 15, 2009

(54) TROLLEY HANGER SYSTEM

(75) Inventors: Michael Foxx, Hillsborough, NJ (US); Larry Hixon, Pittstown, NJ (US); Lin Hua, Jersey City, NJ (US)

(73) Assignee: Strato, Inc., Piscataway, NJ (US)

( * ) Notice: Subject to any disclaimer, the term of this patent is extended or adjusted under 35 U.S.C. 154(b) by 254 days.

(21) Appl. No.: 11/684,983

(22) Filed: Mar. 12, 2007

(65) Prior Publication Data

US 2008/0223247 A1 Sep. 18, 2008

(51) Int. Cl.
*B61G 5/06* (2006.01)
*F16L 3/00* (2006.01)

(52) U.S. Cl. ..... 213/76; 213/1.3; 248/53

(58) Field of Classification Search ..... 213/1.3, 213/76; 248/53
See application file for complete search history.

(56) References Cited

U.S. PATENT DOCUMENTS

| | | | | |
|---|---|---|---|---|
| 581,890 | A * | 5/1897 | Thomas | 285/63 |
| 2,923,509 | A * | 2/1960 | Kolodin | 248/62 |
| 2,996,315 | A | 8/1961 | Roth et al. | |
| 3,344,935 | A | 10/1967 | Stewart et al. | |
| 3,567,041 | A | 3/1971 | Seay | |
| 3,587,868 | A | 6/1971 | Yates | |
| 4,069,836 | A | 1/1978 | Sowinski | |
| 4,099,702 | A | 7/1978 | Temple | |
| 4,133,561 | A | 1/1979 | Cannon et al. | |
| 4,215,881 | A | 8/1980 | Scott et al. | |
| 4,392,575 | A | 7/1983 | Baker et al. | |
| 4,986,500 | A | 1/1991 | Campbell | |
| 7,267,306 | B2 * | 9/2007 | Eason et al. | 248/53 |
| D559,084 | S * | 1/2008 | Foxx et al. | D8/356 |
| 2004/0155005 | A1 | 8/2004 | Murphy | |
| 2006/0163442 | A1 | 7/2006 | Eason | |

OTHER PUBLICATIONS

AAR Manual of Standards and Recommended Practices, Standard S-4021, Apr. 10, 2006.

* cited by examiner

*Primary Examiner*—S. Joseph Morano
*Assistant Examiner*—Zachary Kuhfuss
(74) *Attorney, Agent, or Firm*—Fitzpatrick, Cella, Harper & Scinto

(57) ABSTRACT

A trolley hanger for supporting brake hose connections between rail cars which hangs securely on a trolley rod, and preferably is directly connected to an intermediate hose flange, a train line support casting flange, or trolley pipe flange, prevents lateral and rotational movement of a brake hose connection, thereby reducing unwanted brake hose uncoupling.

8 Claims, 2 Drawing Sheets

TROLLEY HANGER SYSTEM

BACKGROUND OF THE INVENTION

1. Field of the Invention

The present invention is directed to an apparatus for supporting brake hoses between rail cars. Specifically, a trolley hanger according to the invention inhibits excessive movement of an end hose connection, thereby reducing kinks and unintentional hose uncoupling.

2. Description of Related Art

Standards set by the American Association of Railroads ("AAR") specify certain arrangements for attaching end hoses between rail cars, and the end hoses themselves also have a standard length.

One arrangement for supporting brake hose connections is a fixed bracket, illustrated in AAR Standard S-4021. In this arrangement, a bracket is fixedly attached to the yoke between rail cars, so that it moves with the yoke. The bracket supports a train line support union connecting the intermediate hose to the end hose of the rail car.

The perceived problem with the fixed bracket arrangement is that, as the coupling components wear during use, slack develops in the coupling apparatus causing the end hoses of two adjacent cars to become kinked or to uncouple unintentionally.

An alternative to the fixed bracket arrangement is the trolley rod arrangement, in which a trolley rod is affixed directly to the rail car, and a trolley pipe connecting the end hose to the intermediate hose is shackled on the trolley rod, permitting movement in the axial direction of the trolley rod. On the one hand, the trolley rod arrangement accommodates for axial displacement due to wear of the coupling components, and thus reduces kinks. However, the trolley rod arrangement has been shown to be less reliable than the fixed bracket system in that it results in a greater number of unintentional uncouplings of the brake hoses.

It is believed that one problem of the trolley rod arrangement, from the design standpoint, is that the shackle attachment to the trolley rod permits too much lateral and rotational movement of the trolley pipe, which is the element connecting the end hose and the intermediate hose. It would thus be a desirable advance in the art if a reliable system of attaching brake hoses could be developed that used the trolley rod system of supporting the train line union, or trolley pipe, while at the same time reducing the likelihood of unintentional uncoupling, without adding unnecessary complexity or expense to the system.

SUMMARY OF THE INVENTION

Thus, according to the invention, a trolley hanger system for connecting an intermediate hose to an end hose between rail cars comprises a trolley rod fixedly attached to a rail car, having a longitudinal axis generally parallel to the longitudinal axis of the rail car. A hanger supported on the trolley rod has generally parallel front and rear sides oriented perpendicularly to the longitudinal axis of the trolley rod. The recess of the trolley hanger, where the trolley rod supports the hanger, has a curved surface running from the front side to the rear side of the hanger, mating with the trolley rod so that the hanger can rotate around the longitudinal axis of the trolley rod, and slide axially on the trolley rod, but cannot rotate around an axis perpendicular to the longitudinal axis. First and second ears on the hanger are provided for connection to a flange on a trolley pipe, intermediate hose flange or other fitting. In order to accommodate the pipe or flange, the ears are separated by a space wider than the recess into which the trolley rod fits.

DETAILED DESCRIPTION OF THE PREFERRED EMBODIMENTS

Figure 1:
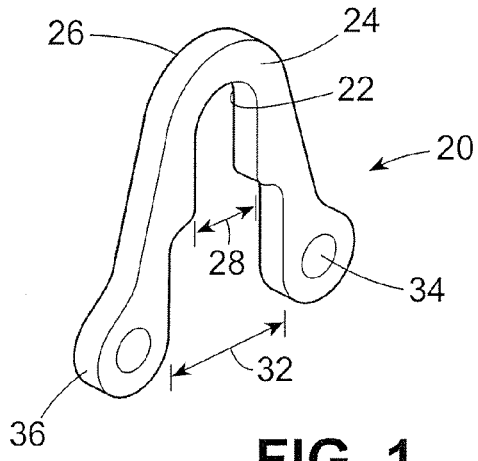
FIG. 1 depicts a trolley hanger according to the invention.

As seen in FIG. 1, the trolley hanger 20 has a recess 28, including curved surface 22 on which a trolley rod supports the hanger. The curved surface 22 extends from front side 24 of the trolley hanger to rear side 26. The front and rear sides are generally parallel and are separated by a distance in a range of about ¼ inch to about ¾ inch. In the most preferred current embodiment, the width of the trolley hanger is about ½ inch. The surface 22 is preferably configured with a straight side to permit the trolley rod hanger to slide axially along the trolley rod and to rotate around the longitudinal axis thereof, but to prevent the trolley hanger from rotating substantially around an axis perpendicular to the longitudinal axis.

In the embodiment shown, recess 28 widens into a recess 32 which accommodates the brake hose line hardware. Substantially similar ears 36 extend on either side to the bottom of the trolley hanger 20 and are provided with through holes 34 which can be used to attach the trolley hanger to a flange 42 on the intermediate hose 40, for example.

Figure 2:
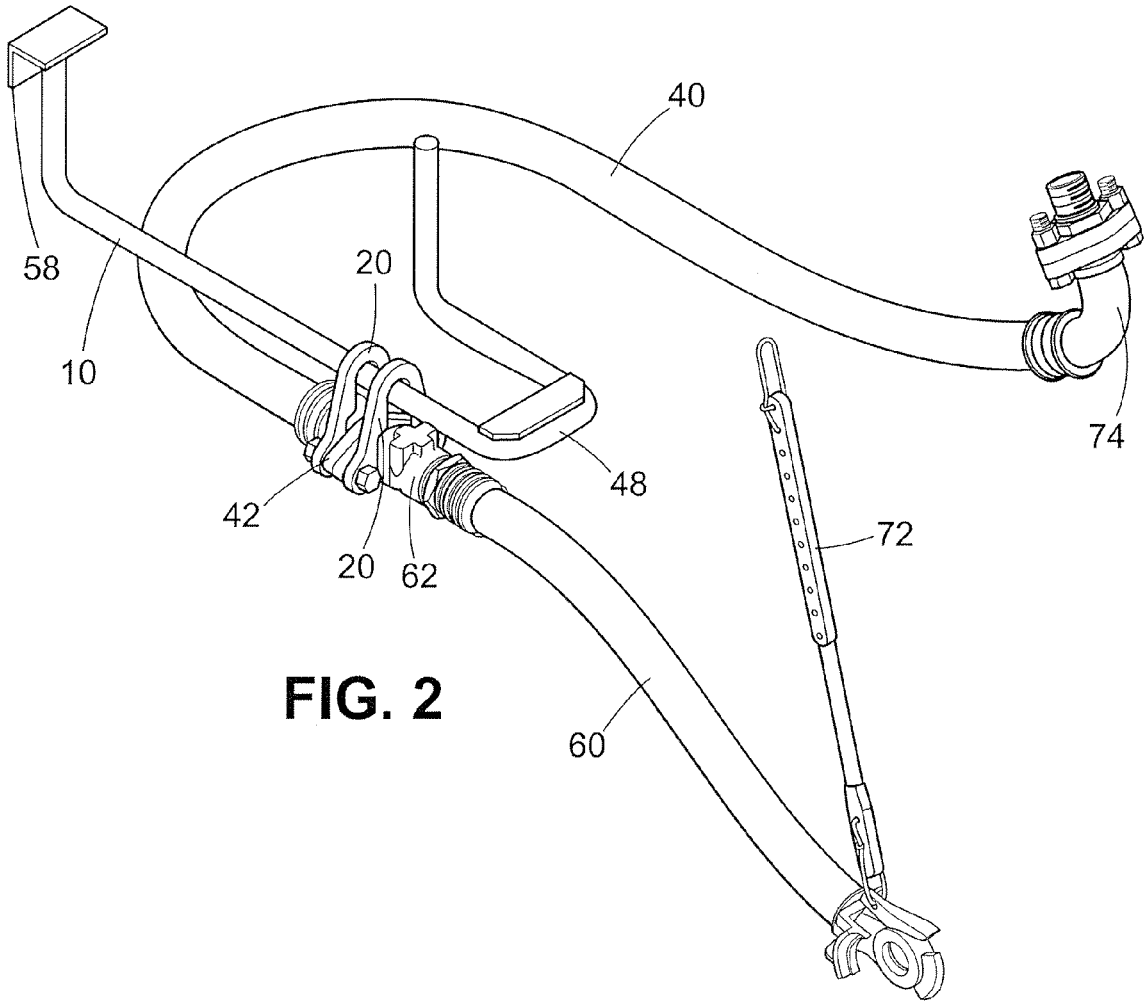
FIG. 2 depicts a trolley hanger system according to an embodiment of the invention, in which a trolley pipe is not used.
Figure 3:
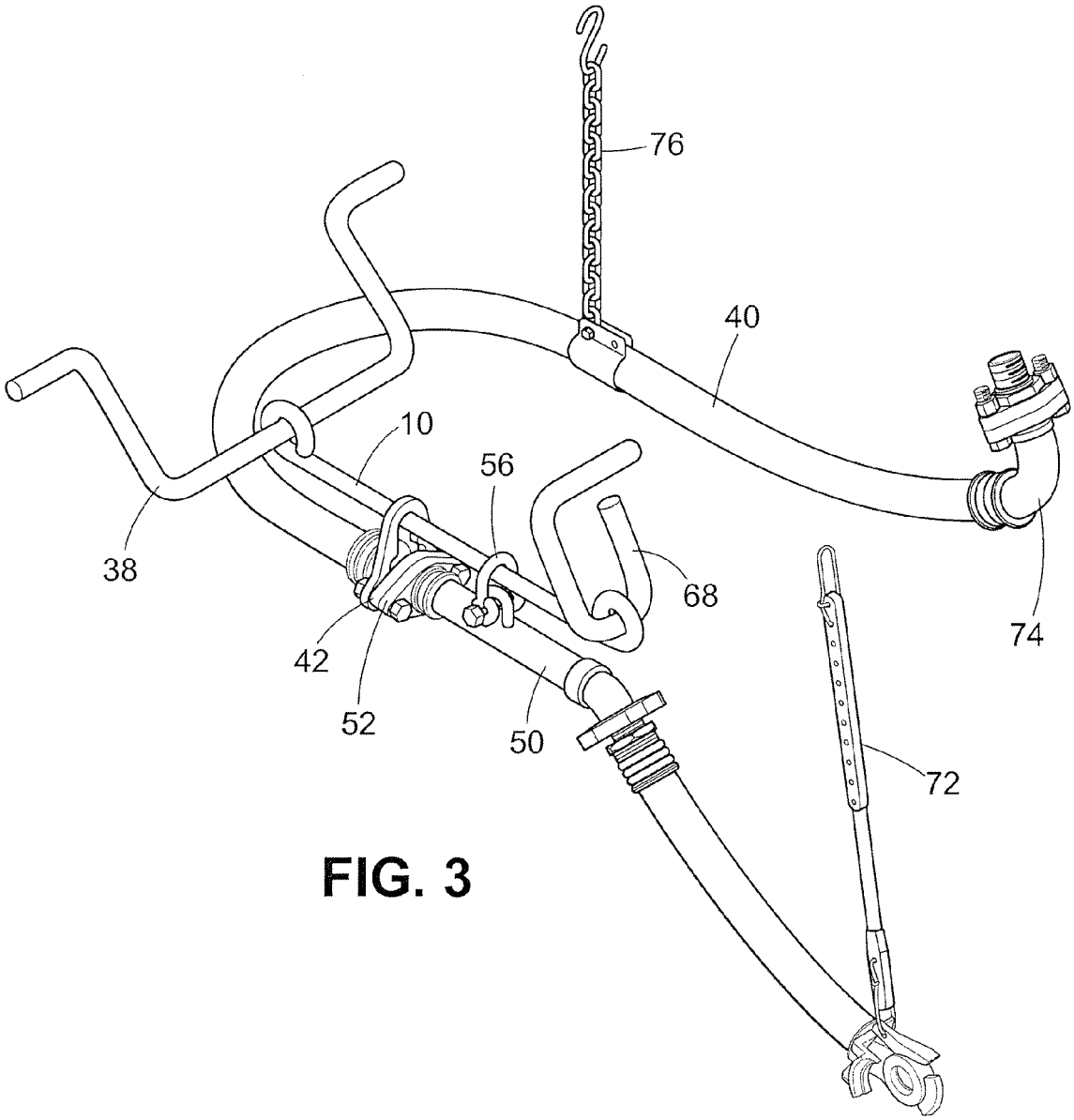
FIG. 3 depicts a trolley hanger system according to an embodiment of the invention wherein the trolley hanger is used in conjunction with a trolley pipe.

As shown in the various embodiments of FIG. 2 and FIG. 3, trolley rod 10 has a longitudinal axis parallel to the longitudinal axis of the rail car, and the trolley hanger 20 slides on the trolley rod 10, allowing some movement in the axial direction. The trolley rod is fixed to the rail car, usually by welding. In FIG. 2, the elements 48, 58 for attaching the trolley rod to the rail car are integral with the trolley rod. In FIG. 3, a plurality of pieces is used to attach the trolley rod to the rail car. However, after assembly, the individual pieces 68, 38 must be tack welded to ensure that the trolley rod is fixed and does not move. The arrangement of the hardware for attaching the trolley rod to the rail car is not critical and many variations meeting AAR standards may be adapted by one of ordinary skill in the art.

The trolley hanger may be attached to the hose line by a variety of methods. For example, the trolley hanger 20 may be bolted to a flange 42 on the intermediate hose 40, aligning through holes 34 with corresponding holes on the flange. Alternatively (in an embodiment not shown), the trolley hanger may be bolted to a flange 52 on the trolley pipe 50.

In one preferred embodiment, depicted in FIG. 3, trolley pipe 50 is shackled to the trolley rod 10 with shackle 56 utilizing conventional attachments on the trolley pipe. In order to prevent unwanted movement of the end hose 60, a trolley hanger according to the invention is attached at the end of the trolley pipe closer to the intermediate hose. In the embodiment shown, the trolley hanger 20 is bolted to a flange 42 on the intermediate hose and another flange 52 on the end of the trolley pipe.

In another preferred embodiment, a plurality of trolley hangers may be used to attach the hose line to the trolley rod.

As shown in FIG. 2, a first trolley hanger is attached to the intermediate hose flange 42, and a second trolley hanger is attached to a flange 64 on the train line support casting 62. Train line support casting 62 has a flange on one side, to accommodate the customarily flanged connection to the intermediate hose, and a threaded connection on the other side, to accommodate the customarily threaded end of the end hose. The use of two trolley hangers in this manner prevents the connection between the intermediate hose and the end hose from moving in a way that would cause unintentional uncoupling, and also eliminates the use of the trolley pipe.

The other features and elements of the brake hose support system described herein and in the Figures are conventional, including end hose strap 72, intermediate hose chain 76 and angle cock adapter 74, whose function and arrangement will be apparent to those of ordinary skill in the art.

The trolley hanger is generally made of steel, but could be made of any suitable metal or alloy known to one of ordinary skill in the art for use in analogous environments. The preferred dimensions of the trolley hanger are largely determined by standardized clearances, and by the dimensions of the brake line hoses themselves, and associated hardware, which are also standardized. Thus, the height of the trolley hanger, the vertical distance from the bottom of the ears to the peripheral surface opposite the hanging surface 22, preferably is in a range of about 4½ inches to about 5½ inches, with the most preferred current embodiment of the trolley hanger having a height of 4-31/32 inches. The distance between the centers of the through holes 34 is preferably in a range of 3½ inches to 4 inches, and 3¾ inches in the most preferred current embodiment. The larger recess 32 has a width preferably in a range of about 2¼ inches to about 2½ inches. Most preferably, the larger recess 32 has a width of 2-5/16 inches to accommodate brake hose hardware as shown in the preferred embodiments illustrated in the Figures. The smaller recess 28, which receives the trolley rod, has a width preferably in a range of about 1 inch to about 1½ inch. Most preferably the smaller recess 28 has a width of 1¼ inch to accommodate the trolley rod. The tapered shape of the trolley hanger shown in the Figures has an aesthetically pleasing appearance, but other designs may be adapted and still retain the functionality of the trolley hanger and remain within the scope of the invention.

Where a particular dimension herein is said to be "about" a given value, it is understood that certain manufacturing tolerances are permitted in this art. Thus, "about" a half-inch thickness is understood to allow a tolerance of ±1/64 inch, a distance of about 3¾ inches between through holes is understood to allow a tolerance of ±0.15 inches, and so on. The foregoing description is intended to be illustrative and not limiting of the invention, which is defined by the appended claims.

What is claimed is:

1. A trolley hanger system for connecting an intermediate hose to an end hose between rail cars, comprising a trolley rod fixedly attached to a rail car, having a longitudinal axis generally parallel to the longitudinal axis of the rail car;

a hanger supported on the trolley rod and having generally parallel front and rear sides oriented perpendicularly to the longitudinal axis of the trolley rod;

a recess having an curved surface running from the front side to the rear side of the hanger, so that the hanger is supported on the trolley rod and can rotate around the longitudinal axis of the trolley rod, but cannot rotate around an axis perpendicular to said longitudinal axis;

first and second ears extending from the hanging surface and terminating at one end of the hanger, at least one of the first and second ears having a through hole for connection to a flange connecting the intermediate hose to the end hose;

wherein the ears are separated by a space wider than the recess and being adapted to receive a pipe or hose fitting.

2. The trolley hanger system of claim 1, wherein the trolley hanger is bolted to an intermediate hose flange, and the through holes in each of the first and second ears of the trolley hanger align with through holes on the intermediate brake hose flange.

3. The trolley hanger system of claim 1, further comprising a train line support casting, wherein the intermediate brake hose and the end hose are connected via the train line support casting without a trolley pipe therebetween.

4. The trolley hanger system of claim 1, further comprising a trolley pipe connected between an intermediate hose and an end hose.

5. The trolley hanger system of claim 4, wherein the trolley pipe is connected to the trolley rod independently of the trolley hanger and the trolley hanger is bolted to a flange on the intermediate hose.

6. The trolley pipe hanger system of claim 1, comprising a plurality of substantially similar trolley hangers.

7. The trolley hanger system of claim 1, wherein the recess in the trolley hanger has a width in a range of about 1 inch to about 1½ inches to accommodate the trolley pipe.

8. A trolley hanger system for connecting an intermediate hose to an end hose between rail cars, comprising a trolley rod fixedly attached to a rail car, having a longitudinal axis generally parallel to the longitudinal axis of the rail car;

a hanger supported on the trolley rod and having generally parallel front and rear sides oriented perpendicularly to the longitudinal axis of the trolley rod, said front and rear sides separated by a distance of about ½ inch;

a recess having a width of about 1¼ inches and a semicircular surface with straight sides running from the front side to the rear side of the hanger, so that the hanger is supported on the trolley rod and can rotate around the longitudinal axis of the trolley rod, but cannot rotate around an axis perpendicular to said longitudinal axis;

first and second ears extending from the hanging surface and terminating at one end of the hanger, each of the first and second ears having a through hole for connection to an intermediate hose flange, the distances between the centers of the through holes being about 3¾ inches.

* * * * *